US009494375B2

(12) United States Patent
Mikroulis

(10) Patent No.: US 9,494,375 B2
(45) **Date of Patent: *Nov. 15, 2016**

(54) UNIVERSAL AK-47 AND VARIANT BOLT HOLD OPEN FOLLOWER

(71) Applicant: Dimitri Mikroulis, Idyllwild, CA (US)

(72) Inventor: Dimitri Mikroulis, Idyllwild, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/790,825

(22) Filed: Jul. 2, 2015

(65) Prior Publication Data

US 2015/0308767 A1 Oct. 29, 2015

Related U.S. Application Data

(62) Division of application No. 13/963,187, filed on Aug. 9, 2013, now Pat. No. 9,103,615.

(60) Provisional application No. 61/683,796, filed on Aug. 16, 2012.

(51) Int. Cl.

| | |
|---|---|
| ***F41A 9/70*** | (2006.01) |
| ***F41A 17/36*** | (2006.01) |
| ***F41A 9/69*** | (2006.01) |

(52) U.S. Cl.

CPC ..... *F41A 9/70* (2013.01); *F41A 17/36* (2013.01); *F41A 9/69* (2013.01)

(58) Field of Classification Search

CPC ..... F41A 9/61; F41A 9/64; F41A 9/65; F41A 9/69; F41A 9/70; F41A 17/36

USPC ..... 42/11, 17, 21, 24, 29, 33, 35, 37, 39, 42/49.01, 50, 70.02

See application file for complete search history.

(56) References Cited

U.S. PATENT DOCUMENTS

| | | | | |
|---|---|---|---|---|
| 4,069,608 | A | 1/1978 | Jurek | |
| 4,586,281 | A | 5/1986 | Chesnut | |
| 4,888,899 | A | 12/1989 | Chesnut et al. | |
| 4,888,900 | A | 12/1989 | Howard | |
| 5,263,273 | A | 11/1993 | Lishness | |
| 5,357,703 | A * | 10/1994 | Chesnut | F41A 17/38 42/50 |
| 5,588,241 | A | 12/1996 | Hurley | |
| 6,367,188 | B1 | 4/2002 | Vargas | |
| 6,606,811 | B1 | 8/2003 | Olson | |

(Continued)

FOREIGN PATENT DOCUMENTS

| | | |
|---|---|---|
| WO | WO 99/05467 | 2/1999 |

OTHER PUBLICATIONS

Stargazer111, Making Bolt Hold Open Magazines, Mar. 25, 2011, ar15.com, found on internet at: http://www.ar15.com/content/page.html?id=665.

(Continued)

*Primary Examiner* — Bret Hayes
(74) *Attorney, Agent, or Firm* — The Compton Law Firm, P.C.; Scott D. Compton

(57) ABSTRACT

A universal cartridge follower for a firearm magazine comprising a cartridge receiving surface and side walls extending from the cartridge receiving surface. The cartridge receiving surface is operationally configured to intercept a firearm bolt. The side walls extend from the cartridge receiving surface and have opposing first surfaces defining a first width of the cartridge receiving surface and at least opposing second surfaces defining a second width of the cartridge receiving surface.

14 Claims, 12 Drawing Sheets

(56) References Cited

U.S. PATENT DOCUMENTS

| | | | | |
|---|---|---|---|---|
| 7,261,029 | B1 | 8/2007 | Davis | |
| 8,028,455 | B1 * | 10/2011 | Battaglia | F41A 9/71 42/49.02 |
| 9,103,615 | B2 * | 8/2015 | Mikroulis | F41A 17/36 |
| 2003/0014896 | A1 | 1/2003 | Fitzpatrick | |
| 2005/0000138 | A1 | 1/2005 | Kiss | |
| 2005/0115128 | A1 | 6/2005 | Hahin | |
| 2011/0113663 | A1 * | 5/2011 | Nakayama | F41A 9/70 42/50 |
| 2011/0167694 | A1 | 7/2011 | Bigley et al. | |
| 2013/0014416 | A1 | 1/2013 | Sisgold | |

OTHER PUBLICATIONS

Author Unknown, Yugoslavian bolt hold open mag followers [sic], July 4, 2007, The AK Files, found on the internet at: http://www.akfiles.com/forurnms/showthread.php?t=25474.

* cited by examiner

UNIVERSAL AK-47 AND VARIANT BOLT HOLD OPEN FOLLOWER

CROSS-REFERENCE TO RELATED APPLICATIONS

This application is a divisional application of U.S. application Ser. No. 13/963,187 filed Aug. 9, 2013, now U.S. Pat. No. 9,103,615, which claims priority on earlier filed U.S. Provisional Application No. 61/683,796, filed on Aug. 16, 2012.

STATEMENT REGARDING FEDERALLY SPONSORED RESEARCH OR DEVELOPMENT

Not applicable.

FIELD OF THE APPLICATION

The application relates generally to cartridge followers including those used with Kalashnikov type firearm magazines.

BACKGROUND

Traditional magazines for Kalashnikov type firearms are designed to stop a cartridge follower at a designated point within the magazine allowing the firearm bolt to close after the last cartridge is fired from the magazine. Although magazines for Kalashnikov type rifles have been made with cartridge followers designed to hold a rifle bolt open after the last cartridge is fired from the magazine, a need still exists to retrofit various traditional magazines with a universal cartridge follower capable of stopping or catching the rifle bolt thereby holding the rifle bolt in an open position when the magazine is emptied of the last cartridge.

SUMMARY

The present application is directed to a cartridge follower for a firearm magazine comprising (1) a cartridge receiving surface operationally configured to intercept a firearm bolt; and (2) side walls extending from the cartridge receiving surface, the side walls having opposing first surfaces defining a first width of the cartridge receiving surface and at least opposing second surfaces defining a second width of the cartridge receiving surface.

The present application is also directed to a Kalashnikov type firearm bolt hold open magazine system including (1) a magazine body for housing a biased member and a cartridge follower therein; (2) the magazine body having one or more raised surfaces extending out from the inner surface of one or more walls of the magazine defining a first distance between opposing inner surfaces of the magazine body; and (3) a cartridge follower including recessed areas on its surface defining a first distance of the cartridge follower, the first distance of the cartridge follower being less than the first distance between the opposing inner surfaces of the magazine body; (4) wherein the cartridge follower may travel within the magazine body unencumbered by the one or more raised surfaces.

The present application is also directed to a method of converting a Kalashnikov type firearm bolt close magazine to a bolt hold open magazine including (1) providing a Kalashnikov type firearm magazine including a closed end and an open feed end, a first cartridge follower housed within the magazine, a floor plate capping the closed end and a spring housed within the magazine and disposed between the cartridge follower and the floor plate, the magazine having one or more raised surfaces extending out from the inner surface of one or more of the walls of the magazine in a manner effective to prevent travel of the cartridge follower to a resting position against an inner surface of the open feed end of the magazine; (2) removing the floor plate, the spring and the cartridge follower from the magazine; (3) attaching the spring to a second cartridge follower having (a) a cartridge receiving surface operationally configured to intercept a firearm bolt; and (b) side walls extending from the cartridge receiving surface, the side walls having opposing first surfaces defining a first width of the cartridge follower and at least opposing second surfaces defining a second width of the cartridge follower; (4) inserting the second cartridge follower into the magazine; and (5) reattaching the floor plate to the magazine.

BRIEF DESCRIPTION

Figure 1A:
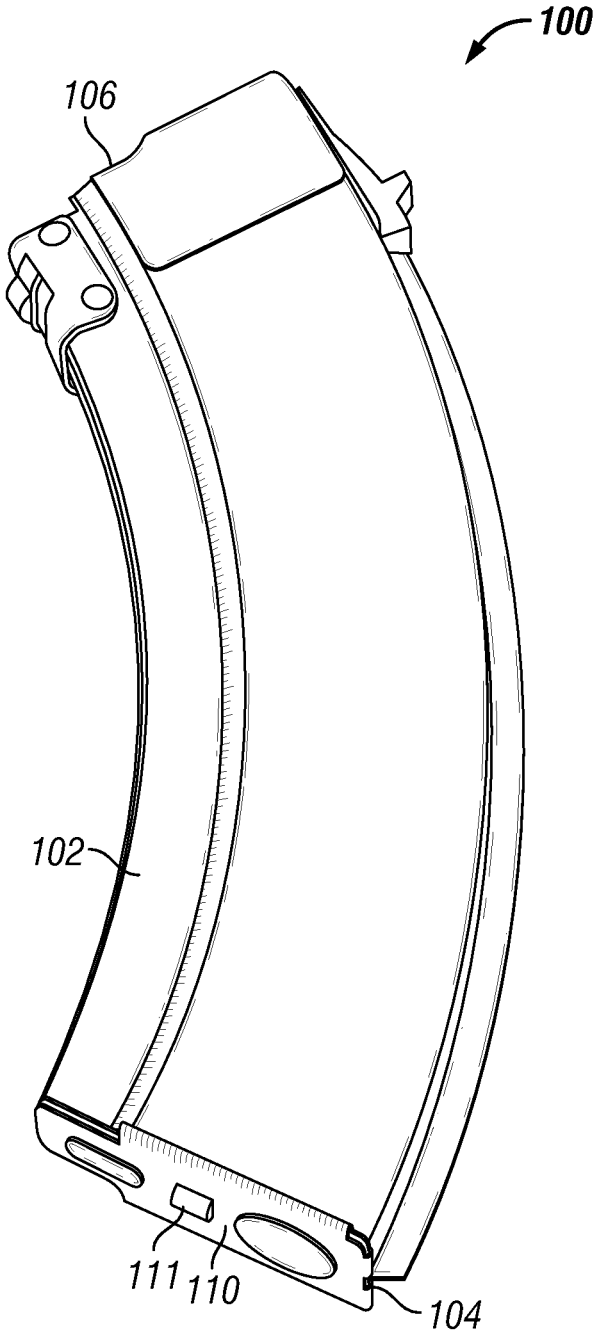
FIG. 1A is a perspective view of an exemplary Kalashnikov type rifle magazine.

It has been discovered that a universal type cartridge follower may be used with firearm magazines including traditional Kalashnikov type rifle magazines, regardless the manufacturer, whereby once the last cartridge is fired and released from the magazine, the follower is operationally configured to prevent the firearm or rifle bolt from advancing to a closed bolt position. Heretofore, such a desirable achievement has not been considered possible, and accordingly, the cartridge follower of this application measures up to the dignity of patentability and therefore represents a patentable concept.

Before describing the invention in detail, it is to be understood that the present apparatus, assembly, system and method are not limited to particular embodiments. It is also to be understood that the terminology used herein is for the purpose of describing particular embodiments only, and is not intended to be limiting. As used in this specification and the appended claims, the term "Kalashnikov type rifle" may also be referred to "AK" type firearms including, but not necessarily limited to the AK-47, AK-74, AKM, MAK-90, MAADI, Krinkov series firearms, and variants as understood by the skilled artisan. Herein, terms such as "ammunition," "rounds" and "cartridges" may be used to describe casings ejected from one or more firearms and projectiles fired out from the barrel of one or more firearms (often referred to by lay persons as bullets). A "magazine" refers to a device attached to a firearm for storing and feeding ammunition to the firearm. Herein, the term "universal" or "universal follower" refers to a bolt hold open follower as described herein operationally configured to be retrofit with commercially available Kalashnikov type rifle magazines characterized by one or more follower stops disposed along the inner surface of the magazine.

In one aspect, the application provides an apparatus, assembly, system and method for preventing a bolt of a firearm from moving or progressing forward after the last round of ammunition has been fired. Such intercepting of the bolt may be effective for signaling to the user of the firearm that the firearm has run out of ammunition, i.e., once the last cartridge has been fired from the firearm magazine.

In another aspect, the application provides a cartridge follower operationally configured to hold the bolt of a firearm open after all the rounds or cartridges have been fired from the firearm.

In another aspect, the application provides a follower operationally configured to bypass follower stops within a corresponding firearm magazine, the follower stops being provided in the form of one or more raised surfaces such as bumps, protuberances, protrusions, bulges, extensions or similar follower stops located along the inner walls of firearm magazines. In another aspect, the follower includes at least a first width less than the narrowest inner width of a corresponding firearm magazine.

In another aspect, the application provides a magazine follower having side walls defined by two or more outer surfaces on each side wall, the surfaces being substantially planarly perpendicular to the longitudinal axis of cartridges to be housed within a corresponding magazine.

In another aspect, the application provides a magazine follower having opposing side walls including (1) at least two outer surfaces disposed substantially planarly perpendicular to the longitudinal axis of cartridges to be housed within the corresponding magazine and (2) at least one outer surface substantially planarly parallel to the longitudinal axis of cartridges to be housed within a corresponding magazine.

In another aspect, the application provides a magazine follower operationally configured to transform standard commercially available bolt closing style magazines into bolt hold open style magazines without the necessity of making any modifications to the magazine body.

In another aspect, the application provides a cartridge follower including recessed areas along the follower surface effective for allowing the follower to bypass any bumps, protuberances, protrusions, bulges, extensions or other follower stops located on the inner surface of the side walls of a corresponding magazine.

In another aspect, the application provides a cartridge follower having opposing outer side walls whereby the side walls are greater in length top to bottom near the back of the follower than near the front of the follower.

In another aspect, the application provides a firearm magazine including one or more follower stops located along one or more of the inner walls of the magazine and a cartridge follower housed therein including a surface configuration operationally configured to avoid contacting the one or more follower stops during operation of the magazine.

In another aspect, the application provides a cartridge engaging surface narrower at two or more locations along the surface. In another embodiment, a cartridge follower may include a cartridge engaging surface defined by at least one non-linear edge.

DISCUSSION

Ammunition magazines are well known in the art of firearms. Their basic construction is a containment shell or housing with two open ends. One end is deemed the "floor" of the magazine and is covered by a plate or "floor plate" while the opposite end is often referred to in the art as the "feed end," which interfaces with the firearm. Inside a magazine is typically found a biased member, including but not necessarily limited to a spring and a cartridge follower. When ammunition is loaded into the magazine, the ammunition engages the cartridge follower directing the cartridge follower toward the floor of the magazine compressing the spring located between the cartridge follower and the floor. During operation, when a single cartridge of ammunition is expended from the magazine, the compressed spring releases and pushes the cartridge follower and ammunition stored in the magazine toward the feed end and the next round of ammunition is thereby readied.

The Kalashnikov rifle and its operation are described in international patent application number WO 99/05467 titled "AUTOMATIC WEAPON 'KALASHNIKOV ASSAULT RIFLE" herein incorporated by reference. Therefore, operation of the Kalashnikov rifle will not be described fully in this application. Kalashnikov type rifles commonly have a stamped steel (or machined steel) receiver body, a removable single (or double) stack stamped steel (or molded plastic box magazine) with a stamped steel (or molded plastic) magazine cartridge follower, and semi-automatic (or automatic) rate fire capability. Although this application is described in conjunction with Kalashnikov type rifles, other types of firearms may too benefit and are not meant to be excluded from the scope of the present application.

Figure 1B:
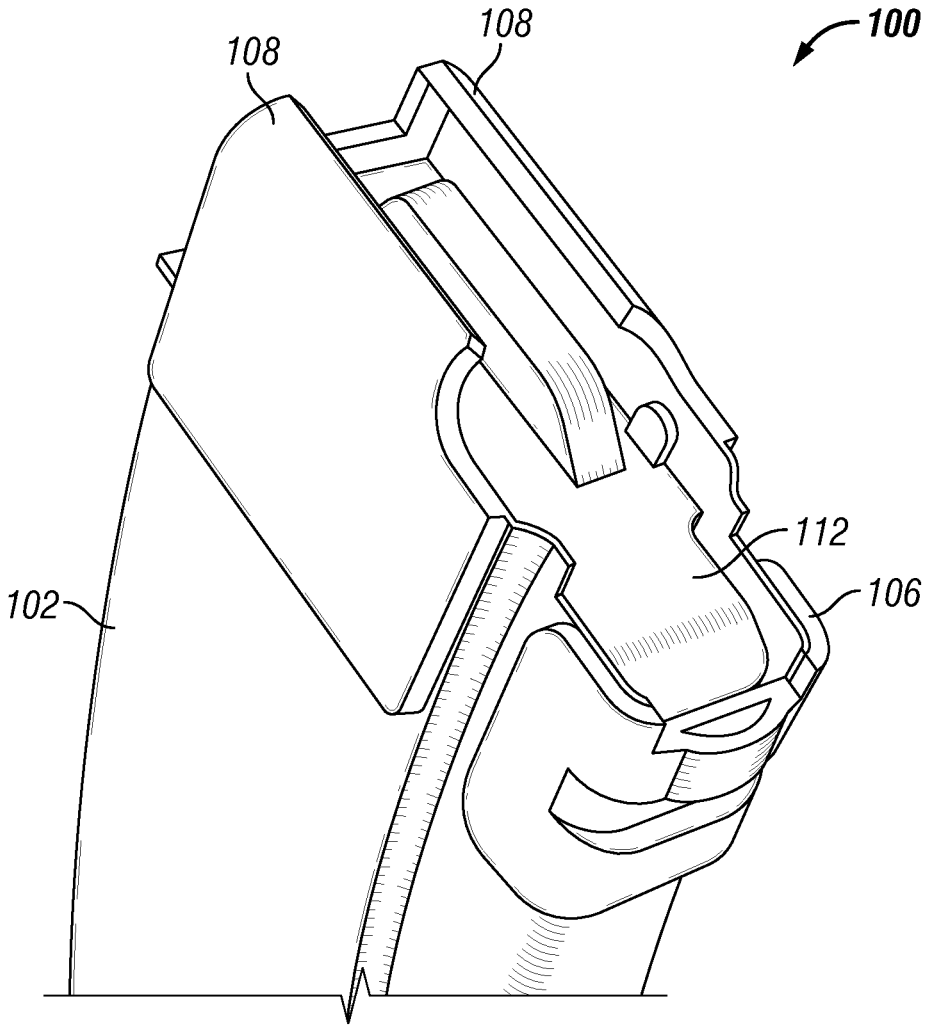
FIG. 1B is a top perspective view of a feed end of an exemplary Kalashnikov type rifle magazine.

An embodiment of a commercially available Kalashnikov or "AK" type firearm magazine 100 known at the time of this application is provided in FIGS. 1A and 1B. As shown, an AK magazine 100 generally comprises a housing 102 having a floor plate or floor 104 and a feed end 106. Feed lips 108 are provided at the feed end 106 to interface with a firearm and to guide cartridges from the magazine 100 into the firing chamber of a firearm. Typically, the feed end 106 is characterized by an opening having an inner perimeter shape tailored to the cartridge and firearm used in connection there with. The floor 104 is capped with a floor plate 110. A spring (not shown) is constrained within the housing 102 by the floor plate 110 (or other lock plate connected thereto), and provides tension to bias a cartridge follower 112 (hereafter "follower 112") in a manner effective for the follower 112 to progress through the magazine housing 102 toward the feed end 106 as ammunition is fired from the firearm. In one exemplary embodiment, the floor plate 110 may include an aperture there through whereby a spring release 111 may be operationally configured to assist in holding the floor plate in secure attachment to the housing 102. As understood by the skilled artisan, the spring release 111 may be pressed or otherwise directed inward through the aperture to remove the floor plate from the housing 102.

Figure 1C:
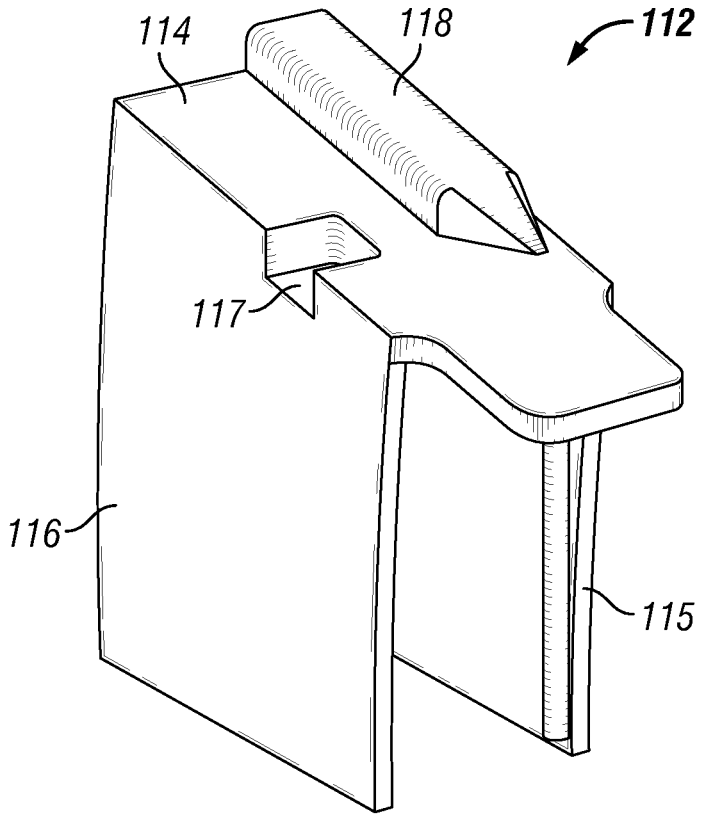
FIG. 1C is a front perspective view of a commercially available Kalashnikov type rifle magazine cartridge follower.

An embodiment of a commercially available Kalashnikov follower known at the time of this application is provided in FIG. 1C. In one aspect, a known AK follower 112 may be defined by a substantially planar cartridge surface or upper surface 114 and a pair of opposed left side and right side walls 115, 116 depending from the upper surface 114 providing a receiving space between the side walls 115, 116 into which the upper portion of the spring 120 (not shown) projects. As depicted, the left side and right side walls 115, 116 include substantially planar outer surfaces forming angles about 90.0 degrees with the upper surface 114.

Figure 1D:
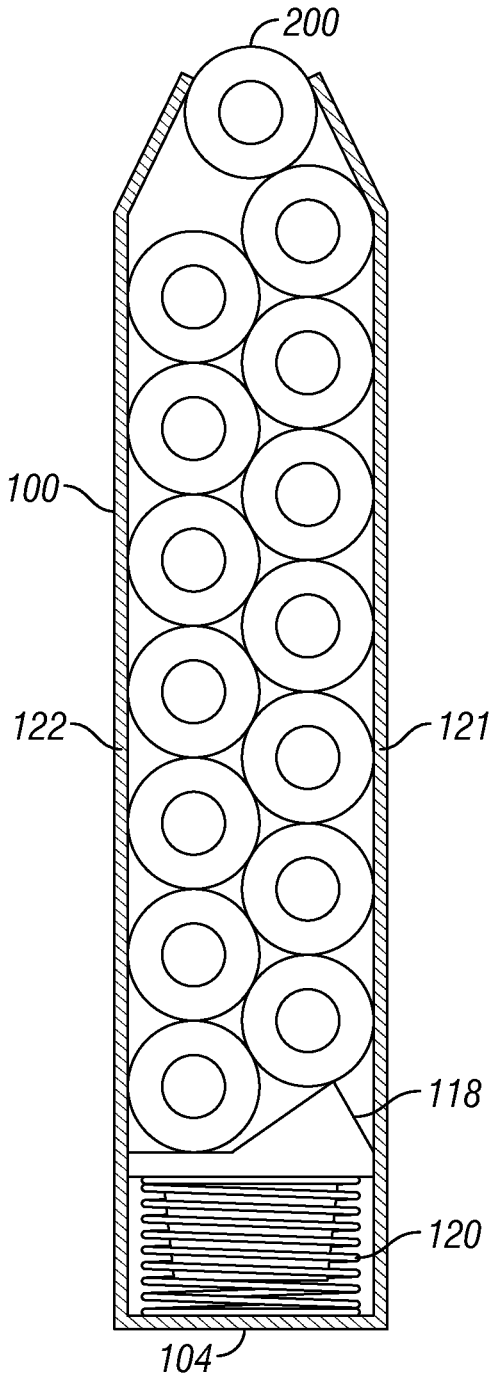
FIG. 1D is a phantom side elevational view of a commercially available Kalashnikov type rifle magazine full of cartridges.

The upper surface may also include a recessed portion 117 for attachment of the upper portion of the spring as understood by persons of ordinary skill in the art and a raised portion 118 for acting upon cartridges housed within the magazine 100. As shown in the simplified embodiment of FIG. 1D, the raised portion 118 is operationally configured to provide storage of cartridges 200 within a magazine 100 in a staggered or zigzag fashion as shown.

Figure 2A:
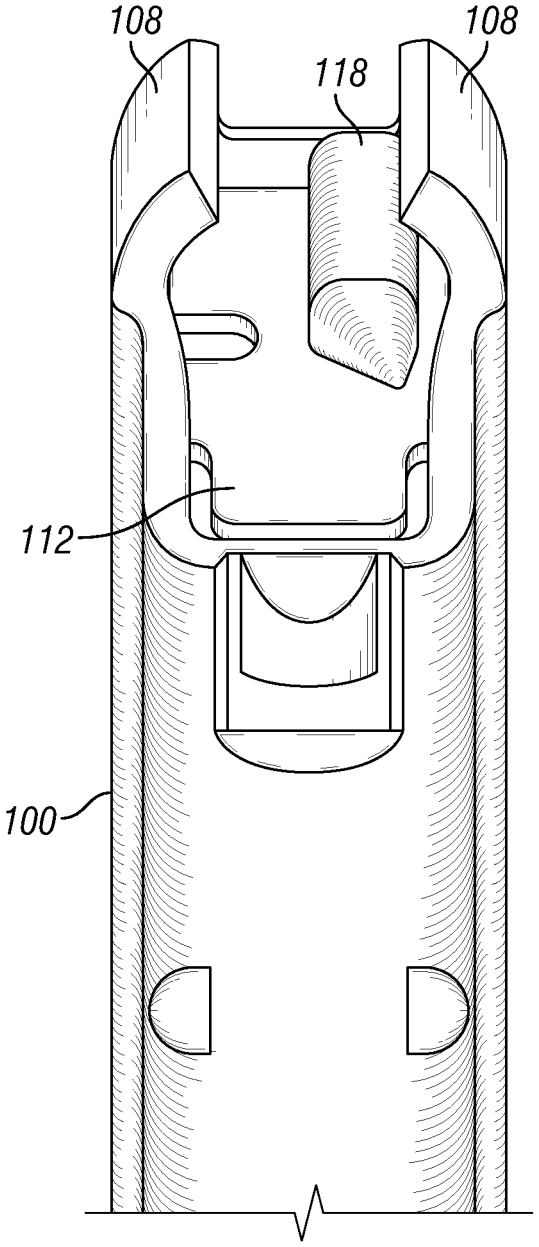
FIG. 2A is a front view of a feed end of an exemplary Kalashnikov type rifle magazine.

As previously mentioned, Kalashnikov type firearms or rifles are designed to stop a cartridge follower 112 at a designated point within a magazine allowing the rifle bolt to close after the last cartridge is fired from the magazine 100. As shown in FIG. 2A, magazines 100 for typical Kalashnikov type rifles are operationally configured to stop the follower 112 at a point below or apart from the feed lips 108 of the magazine 100, whereby the raised portion 118 is prevented from contacting a corresponding feed lip 108 as depicted in FIG. 2A. Thus, the stopping mechanism of the magazine 100 controls the travel distance of the follower 112 allowing the rifle bolt to travel to a closed position by passing the raised portion 118 after the final round or cartridge is fired from the magazine 100.

Figure 2B:
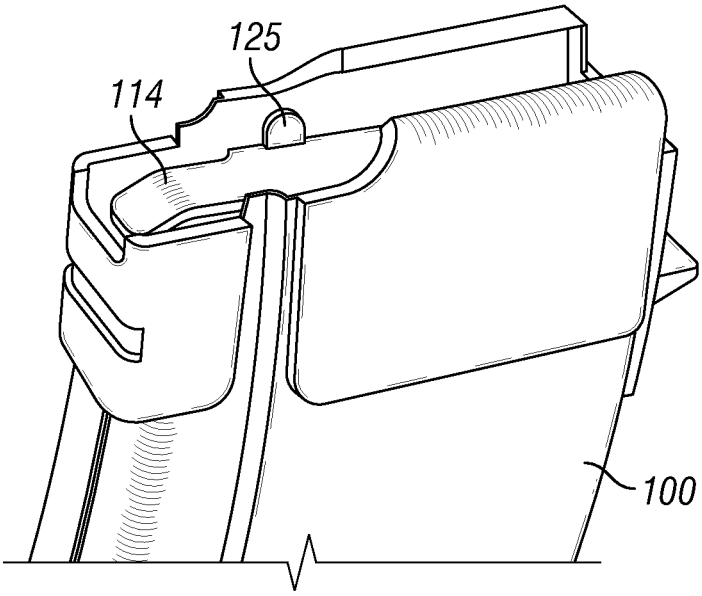
FIG. 2B is top perspective view of a feed end of an exemplary cartridge empty Kalashnikov type rifle magazine with follower.
Figure 2C:
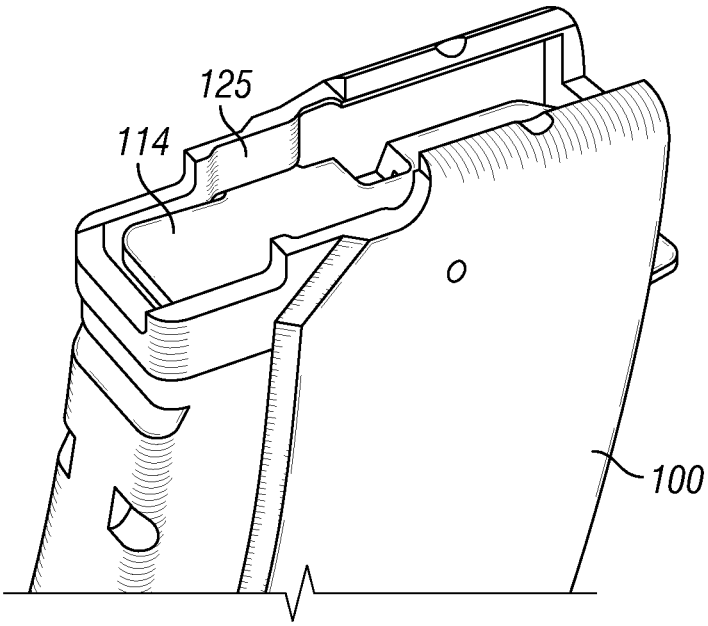
FIG. 2C is top perspective view of a feed end of another exemplary cartridge empty Kalashnikov type rifle magazine with follower.

Typical follower stopping mechanisms or stops 125 may include raised surfaces or surface areas or projections extending out from the inner surface of one or more of the wall, including side walls 121, 122 of the magazine 100, a distance operationally configured to block or otherwise prevent travel of the follower 112 beyond the point of contact between the stop 125 and follower 112 preventing the raised portion 118 from contacting the corresponding feed lip 108. Typically, stops 125 are located along the inner surfaces of one or more of the side walls 121, 122 at one or more points suitable to ensure that the follower 112 to does not impede travel of the rifle bolt from an open position to a closed position after the final round or cartridge is fired from the magazine 100. As shown in FIG. 2B, one common Kalashnikov type rifle magazine includes a stop 125 provided as a raised bump type member for catching the upper surface 114 of a corresponding follower 112. In another embodiment, a stop 125 may be provided as a raised surface portion including a surface operationally configured to catch the upper surface 114 of a corresponding follower 112 as shown in FIG. 2C. Other magazines 100 may be provided with other stops 125 in the form of one or more protuberances, protrusions, bulges, and the like extending out from one or more of the inner surfaces of the magazine 100 side walls 121, 122 for catching corresponding followers 112 therein.

With an understanding of the design of known magazines 100 for Kalashnikov type rifles as discussed above, the novelty of the present follower may be appreciated. In one implementation, commercially available magazines 100 provided with one or more follower stops 125 may be retrofit with the follower of this application to provide or otherwise allow for bolt closing action of a firearm once a final round has been fired from the firearm. Suitably, the present follower is operationally configured to bypass known follower stops 125 during operation. Likewise, the present follower is suitably operationally configured to stop or catch a bolt of a firearm after the final round has been discharged from the magazine 100. In addition, the present follower is suitably operationally configured to distribute or transfer impact related energy upon stoppage of a firearm bolt. The present follower is also operationally configured to operate with all existing Kalashnikov type magazine floor plates without disrupting or otherwise altering a particular magazine's intended round capacity.

Figure 3:
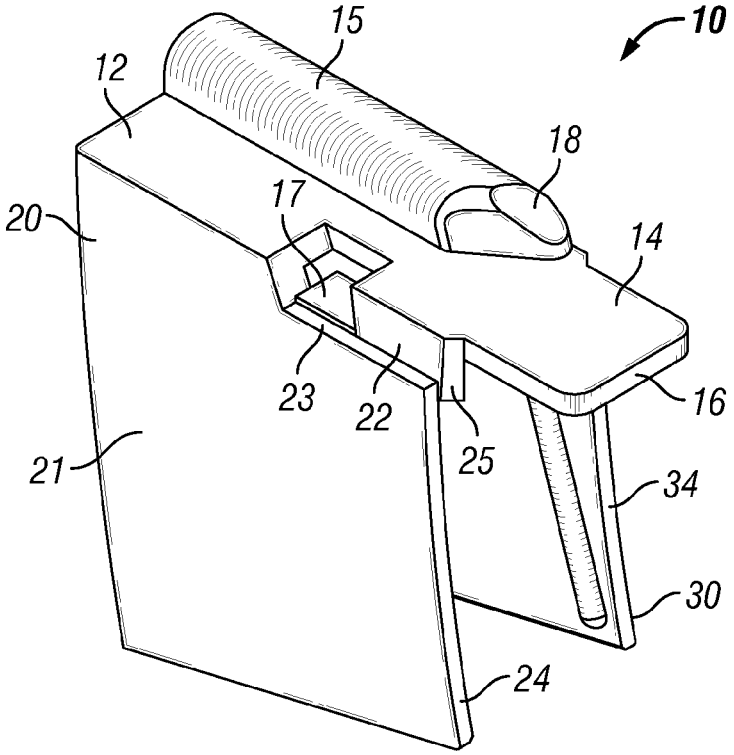
FIG. 3 is a perspective view of an embodiment of a cartridge follower of the present application.
Figure 4:
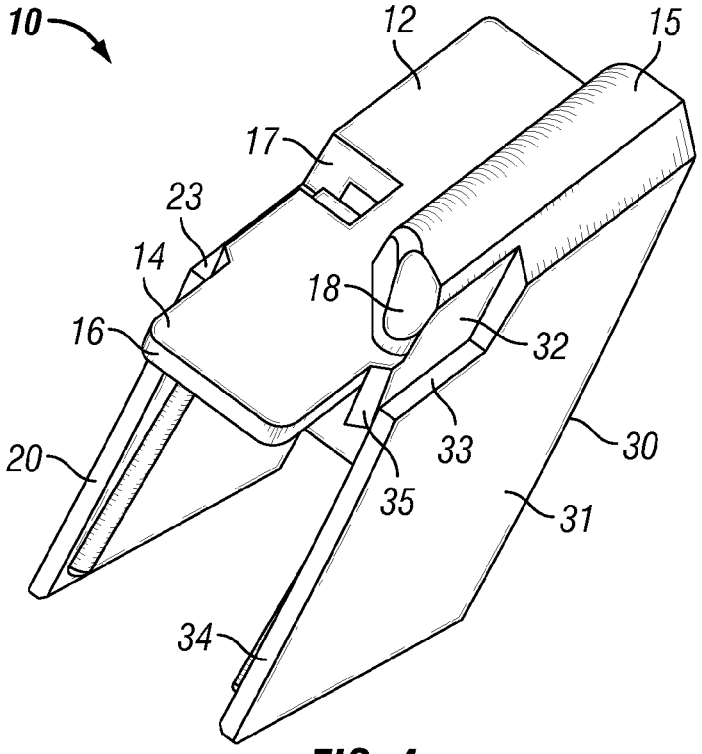
FIG. 4 is another perspective view of a cartridge follower of the present application.
Figure 5:
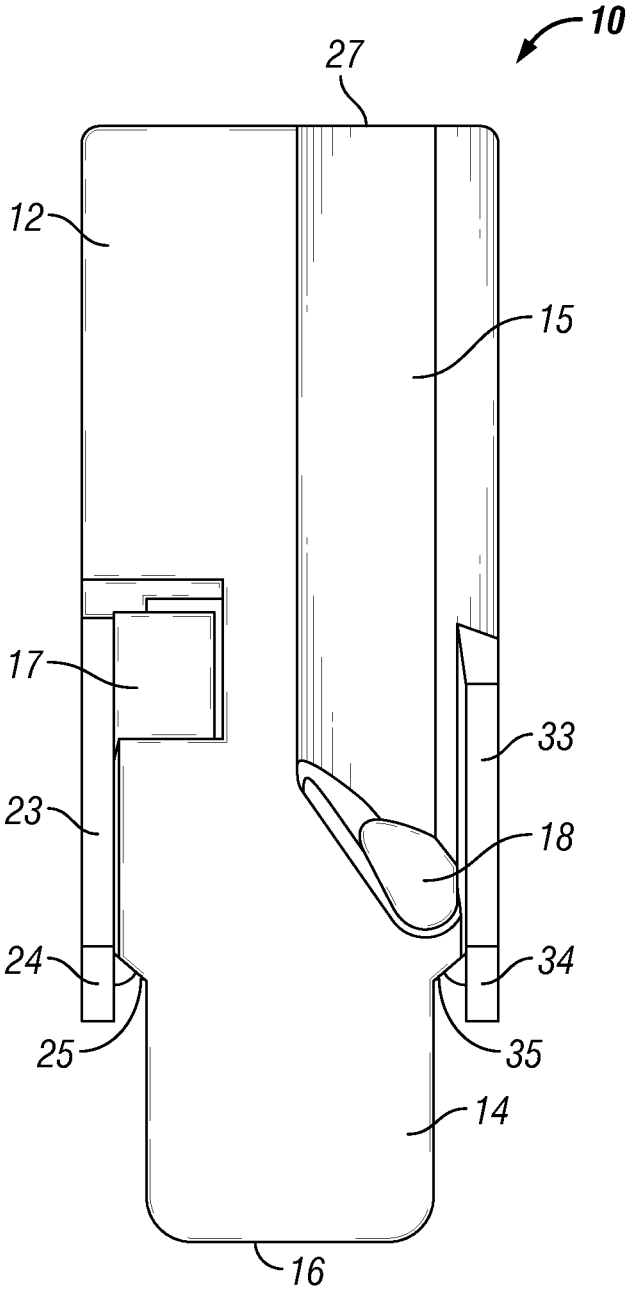

Turning to FIGS. 3-5, one suitable embodiment of the present cartridge follower 10 (hereafter "follower 10") is provided. As shown, the follower 10 suitably includes (1) a substantially planar cartridge surface 12 for engaging a cartridge housed within a corresponding magazine and (2) first and second side walls 20, 30 depending from the cartridge surface 12, the follower 10 having a size and shape effective to reside within one or more target magazines 100 as desired. In this embodiment, the first side wall 20 suitably includes a first outer surface 21 and at least a second outer surface 22 and the second side wall 30 suitably includes a first outer surface 31 and at least a second outer surface 32 (see FIG. 4). The first surfaces 21, 31 define a first width of the cartridge surface 12 and the second surfaces 22, 32 define a second width of the cartridge surface 12.

Still referring to FIGS. 3-5, each of the side walls 20, 30 further includes a shoulder 23 and 33 defining a junction between the first surfaces 21, 31 and the second surfaces 22, 32. With particular attention to FIGS. 3-4, the first side wall 20 includes a first face 24 intersecting the first outer surface 21 and a second face 25 intersecting the second outer surface 22. The second side wall 30 includes a first face 34 intersecting the first outer surface 31 and a second face 35 intersecting the second outer surface 32. As desired, the follower 10 may also include a recessed portion 17 similar as known followers, which is operationally configured to receive a portion of the spring housed within the magazine 100. In another embodiment it is contemplated that the shoulders 23, 33 may be disposed from the front of the side walls 21, 22 to the back of the side walls 21, 22 defining second surfaces 22, 32 running from the front of the follower 10 to the back of the follower 10.

The cartridge surface 12 suitably includes (1) a ledge 14 extending beyond the faces 24 and 34 and (2) a raised surface or raised surface member 15 (hereafter referred to as a "bolt stop") as shown. The ledge 14 suitably includes a face 16 and the bolt stop 15 suitably includes a face 18 with a substantially planar surface operationally configured to assist the release of cartridges from the magazine 100 during firearm operation. Without limiting the invention to a particular embodiment, the ledge face 16 may include a substantially planar surface lying substantially planarly perpendicular to the cartridge surface 12. As shown, the surface of the bolt stop face 18 may lie on a plane dissimilar to the planes of (1) the cartridge surface 12, (2) the first outer surfaces 21, 31, (3) the second outer surfaces 22, 32, (4) the shoulder 23, 33 surfaces, (5) shoulder faces 25, 35 and (6) face 16.

Figure 6:
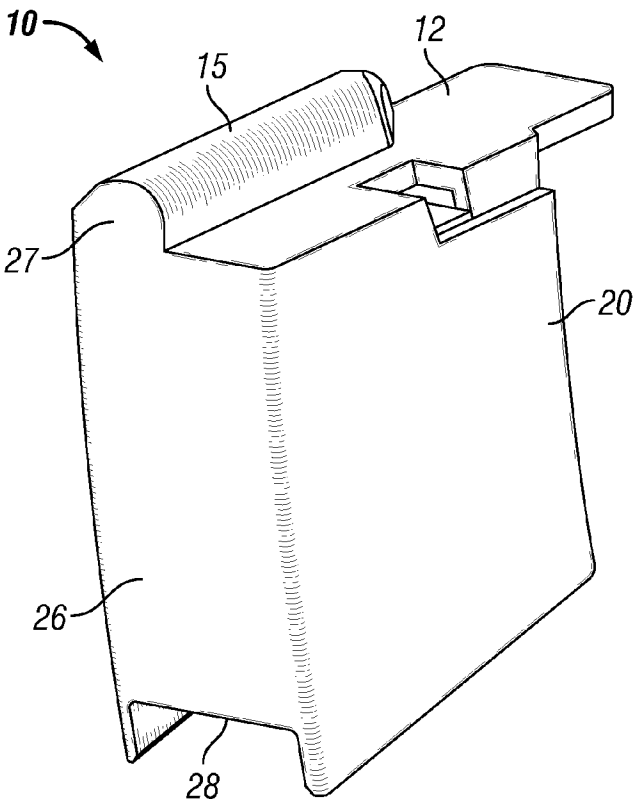
FIG. 6 is a back perspective view of a cartridge follower of the present application.

Turning to FIG. 6, the follower 10 may also include a back wall 26 depending from the cartridge surface 12. As shown, the back wall 26 may include a relief cut 28 operationally configured to provide spacing for floor plates of commercially available magazines 100. In another embodiment, the follower 10 may include a lattice type structure or a partial backing disposed between the first and second side walls 20, 30 as desired. In still another embodiment, the follower 10 may be provided without a back wall 26 altogether. As depicted in FIG. 6, the bolt stop 15 suitably includes an impact surface 27 operationally configured to intercept, stop and hold a bolt in a static position once a final round is discharged from a magazine 100.

In one embodiment, the follower 10 may be comprised of a one piece construction. In another embodiment, the follower 10 may be provided as an assembly of parts. Thus, the follower 10 may be constructed from a mold or similar device. In another embodiment, the follower 10 may be assembled from cartridge follower pieces of like or dissimilar materials of construction. In still another embodiment, the follower 10 may be produced using 3-D printing technology as understood by the skilled artisan.

Suitably, the follower 10 is constructed from one or more materials durable enough to operate as a bolt hold open follower for firearms. More particularly, the follower 10 is suitably constructed from one or more materials including but not necessarily limited to those materials resistant to chipping, cracking, excessive bending and reshaping as a result of ozone, weathering, heat, moisture, other outside mechanical and chemical influences, as well as various impacts and other loads placed on the follower 10. Likewise, the follower 10 may comprise any color or combination of colors, or in the alternative, the follower 10 may be transparent and/or translucent as desired.

Suitable follower 10 materials may include but are not necessarily limited to metals, plastics, rubbers, woods, graphite, PLEXIGLAS, i.e., polymethylmethacrylate, polytetrafluoroethylene ("PTFE"), composite materials, and combinations thereof. Suitable plastics may include, but are not necessarily limited to, polyolefins such as polyethylene, polypropylene, polyoutylene, polyhexylene, polystyrene, polyalphamethylstyrene, and the like or copolymers thereof, acrylics, urethanes, polyesters, thermoplastics, thermal setting resins, thermoplastic elastomers, liquid crystal polymers, polyalkyleneoxides, or any other structural plastic suitable for making a durable follower 10. In one particular embodiment, the follower 10 may be constructed from glass-filled polymer. In another particular embodiment, the follower 10 may be constructed from injection-molded, glass-filled military-spec black polymer as understood by persons of ordinary skill in the art of firearms. Suitable metals may include, but are not necessarily limited to aluminum and its alloys such as aluminum-magnesium alloys and the like, titanium, steel and other iron alloys, copper and its alloys such as bronze, brass and the like, and any other metal or its alloys as desired, and combinations thereof. Steels may be defined herein as a large family of metal alloys in which iron is mixed with carbon and other elements, and may be described as mild, medium or high-carbon steels according to the percentage of carbon they contain. Some exemplary types of steel that may be used herein include, but are not necessarily limited to carbon steel, stainless steel, and combinations thereof. Suitable composite materials include, but are not necessarily limited to polymer matrices selected from the plastics listed above reinforced by a fiber such as carbon fibers, polyamides such as DuPont™ Kevlar®, boron-nitride fibers, glass fibers, and combinations thereof. The follower 10 may also include an outer surface finish as desired. Without limiting the invention, one suitable plastic follower 10 may include an outer surface finish of SPI B3 or better, as such is understood by the skilled artisan with knowledge of the Society of the Plastics Industry's Finishing Guide (see http://www.plasticsindustry.org/).

Figure 7:
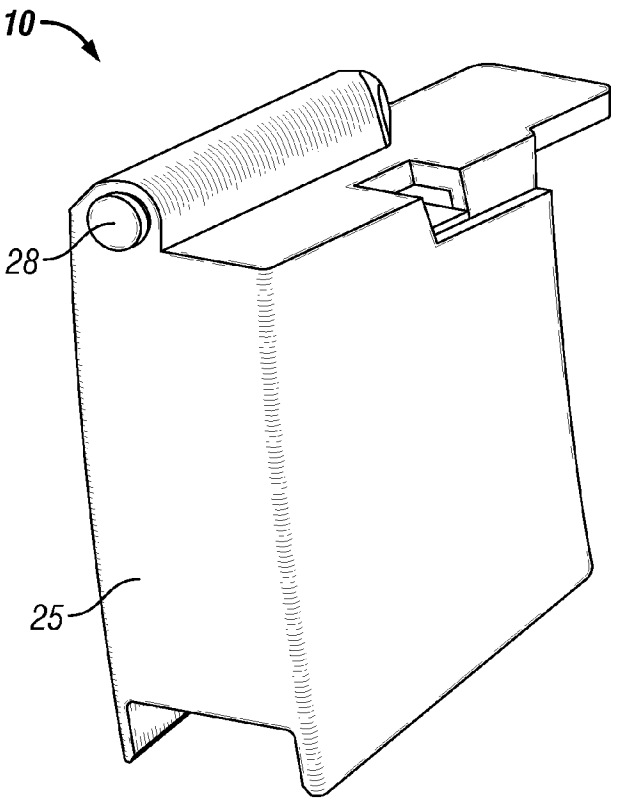
FIG. 7 is a back perspective view of another cartridge follower of the present application.

In an embodiment of the follower 10 as depicted in FIG. 6 including a follower 10 constructed from one or more plastics, the bolt stop 15 may be reinforced with one or more materials operationally configured to maintain the durability of the bolt stop 15 over time. For example, the bolt stop 15 may include or otherwise be reinforced or impregnated with a metal insert or otherwise be reinforced with one or more metals or other durable materials, or combinations thereof. As shown in FIG. 7, the impact surface 27 of the follower 10 may include an external member 28 attached to the bolt stop 15 that is operationally configured to receive impacts from firearm bolts. In one embodiment, the external member 28 may include a metal insert attached in either (1) a permanent manner or (2) a removable or replaceable manner. One exemplary metal insert may include a steel insert. A particular steel insert may include a carbon steel insert.

Figure 8:
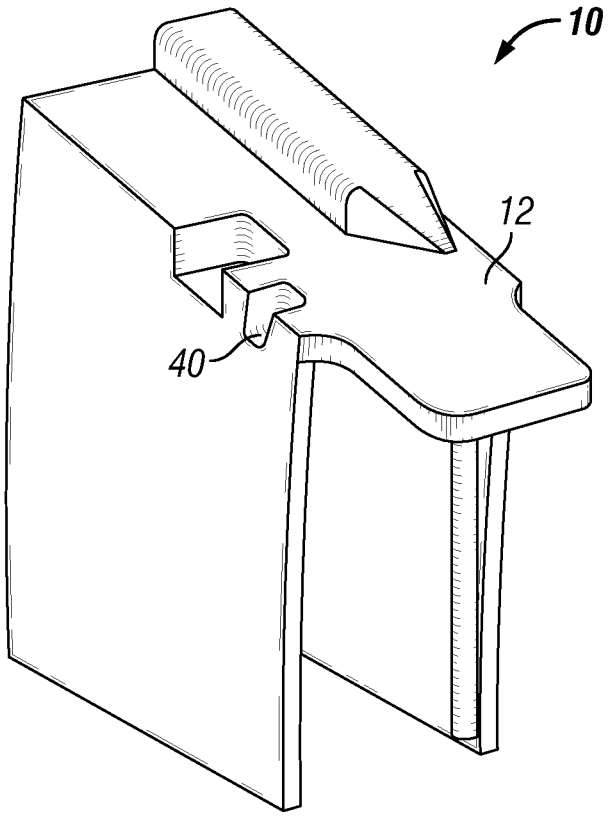
FIG. 8 is a front perspective view of another cartridge follower of the present application.

As discussed above, the present follower 10 is operationally configured to bypass stops 125 as discussed above that may include various sizes and shapes. Thus, it is further contemplated that a particular follower 10 may be configured for use with a particular commercially available magazine. For example, where a known magazine includes follower stops 125 of a given size and shape, e.g., a raised bump surface, a corresponding follower 10 may be configured to include recessed regions 40 (see FIG. 8) along the cartridge surface 12 and the side walls 20, 30 shaped according to the size and shape of the stops 125 and large enough to allow the follower 10 to bypass the stops 125 during operation. As understood by the skilled artisan, the recessed regions 40 may vary in size and shape depending on the size and shape of corresponding stops 125 of one or more target magazines 100.

Figure 9:
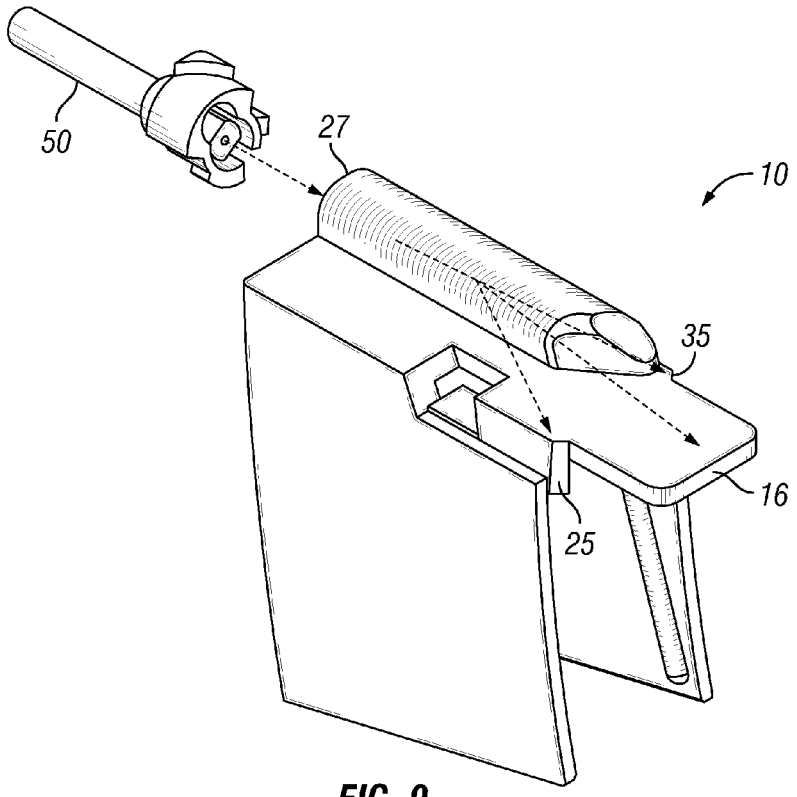
FIG. 9 is a front perspective view of a cartridge follower of the present application and an exemplary firearm bolt in relation thereto.
Figure 10:
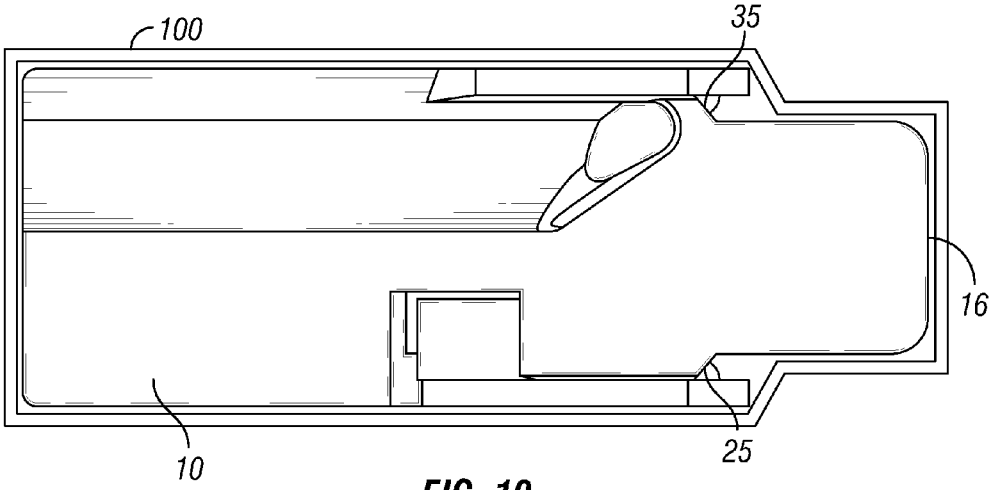
FIG. 10 is a top view of a cartridge follower of the present application housed within a cartridge magazine.
Figure 11:
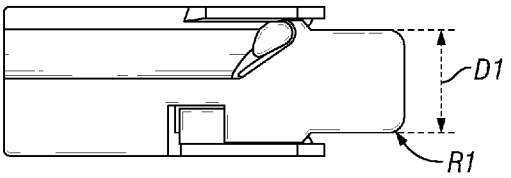
FIG. 11 is a top view of a follower of the present application.
Figure 12:
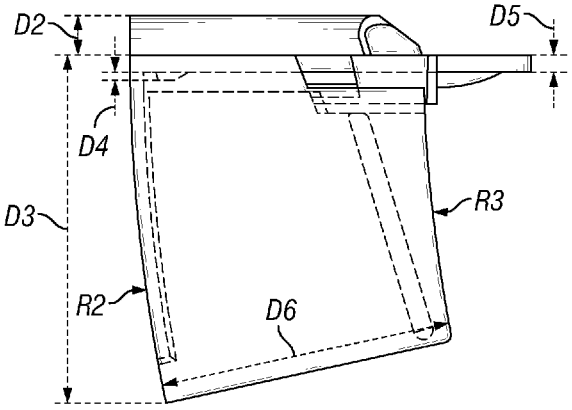
FIG. 12 is a side phantom view of the follower of FIG. 11.
Figure 13:
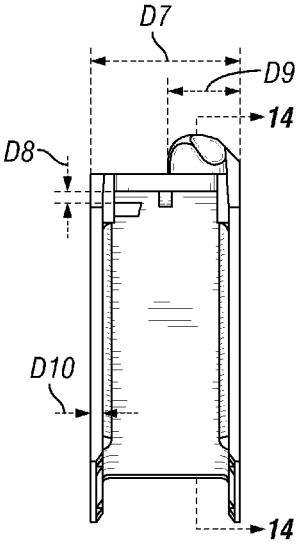
FIG. 13 is a front elevational view of the follower of FIGS. 11 and 12.
Figure 14:
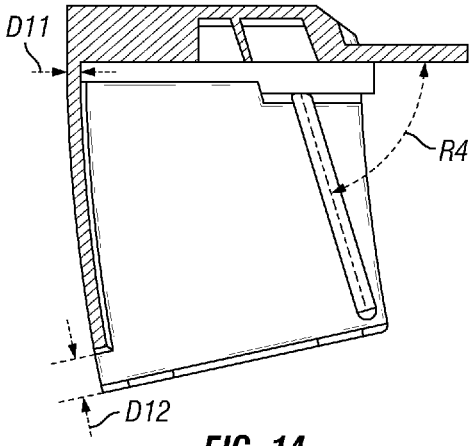
FIG. 14 is a sectional side view of the follower of FIGS. 11, 12 and 13.
Figure 15:
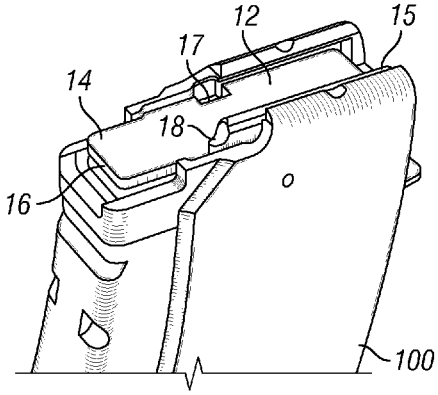
FIG. 15 is a perspective view of the follower of FIGS. 11, 12, 13 and 14 enclosed within a cartridge empty Kalashnikov type rifle magazine.

Turning now to FIG. 9, a simplified illustration is provided representing the transfer of energy (see arrows) from the impact surface 27 of a follower 10 to the front side of the follower 10 after a bolt 50 has contacted the impact surface 27 after a final round is released from a magazine. Suitably, one or more of the faces 16, 25 and 35 of the follower 10 are operationally configured to contact the inner perimeter of a magazine 100 (see FIG. 10) following impact of a bolt 50 against the impact surface 27 depending on the configuration of the follower 10 and/or the corresponding magazine 100. Thus, another feature of the present follower 10 is its ability to provide one or more impact absorbing surfaces operationally configured to contact one or more points along the inner surface of magazines 100 from one or more commercial sources and/or manufacturers. Thus, it is further contemplated that a follower 10 may be provided having a particular outer surface configuration for use with one or more particular commercially available magazines 100, the follower 10 being operationally configured to maximize the energy absorption of the follower 10 upon impact of a bolt 50 with the follower 10. As such, it is further contemplated that the size and shape of the bolt stop 15 may vary as desired.

The invention will be better understood with reference to the following non-limiting examples, which are illustrative only and not intended to limit the present invention to a particular embodiment.

Example 1

In a first non-limiting example, a follower 10 constructed from glass-filled polymer is provided. With reference to FIGS. 11-14, the follower 10 is described as follows:

D1: about 1.45 cm (about 0.570 inches)
D2: about 0.56 cm (about 0.220 inches)
D3: about 4.83 cm (about 1.900 inches)
D4: about 0.13 cm (about 0.050 inches)
D5: about 0.29 cm (about 0.090 inches)
D6: about 4.09 cm (about 1.612 inches)
D7: about 2.08 cm (about 0.820 inches)
D8: about 0.17 cm (about 0.065 inches)
D9: about 1.00 cm (about 0.395 inches)
D10: 2× about 0.17 cm (2× about 0.065 inches)
D11: about 0.18 cm (about 0.072 inches)
D12: about 0.53 cm (about 0.210 inches)
R1: about 0.093
R2: about 9.520
R3: about 7.910
R4: 2× about 73.0

Example 2

In a second non-limiting example, a commercially available AK-47 magazine 100 is retrofit with a follower 10 of the present application according to the following steps:

(1) Remove the floor plate 110 from the magazine housing 102 by pressing in the spring release 111 through the aperture of the floor plate 110;
(2) Remove the spring 120 from the housing 102;
(3) Remove the follower 112 from the housing 102;
(4) Attach the spring 120 to the follower 10 of the present application;
(5) Insert the follower 10 into the housing 102;
(6) Reattach the floor plate 110 to the housing 102; and
(7) Attach the spring release 111 to the floor plate 110 by setting the spring release 111 through the aperture of the floor plate 110 thereby securing the floor plate 110 to the housing 102.

As will be understood by those of ordinary skill in the art, and others, many modifications may be made without departing from the spirit and scope of the invention. The embodiments described herein are meant to be illustrative only and should not be taken as limiting the invention, which is defined in the following claims.

I claim:

1. A cartridge follower for a firearm magazine including:

a cartridge receiving surface including a planar surface portion and a raised surface portion operationally configured to intercept a firearm bolt; and side walls depending from the cartridge receiving surface, the side walls having opposing first surfaces defining a first width of the cartridge receiving surface and at least opposing second surfaces defining a second width of the cartridge receiving surface wherein the second surface of one side wall depends from the planar surface portion and the second surface of the other side wall depends from the raised surface portion;

wherein the cartridge follower is defined by a front and a back, including a back wall attached to the opposing first surfaces and depending from the planar surface portion and the raised surface portion, the opposing first surfaces of the side walls being greater in length top to bottom near the back of the follower than near the front of the follower;

wherein the opposing first surfaces include first front faces of the side walls and the opposing second surfaces include second front faces of the side walls; and wherein the cartridge receiving surface includes a ledge extending beyond the first and second front faces of the side walls.

2. The cartridge follower of claim 1 wherein the length of the opposing first surfaces from the back of the follower to the front of the follower is greater than the length of the raised surface portion of the cartridge receiving surface.

3. The cartridge follower of claim 2 wherein the raised surface includes an impact surface operationally configured to intercept a firearm bolt.

4. The cartridge follower of claim 2 further including one or more surfaces operationally configured to contact an inner surface of a corresponding firearm magazine upon interception of a firearm bolt by the cartridge receiving surface.

5. The cartridge follower of claim 2 wherein the cartridge follower is constructed from injection-molded, glass-filled polymer.

6. The cartridge follower of claim 2 wherein the raised surface portion is reinforced with one or more metals.

7. The cartridge follower of claim 1 wherein each of the side walls include a shoulder including a planar surface defining a junction between the opposing first surfaces and opposing second surfaces of the side walls.

8. The cartridge follower of claim 7 wherein the shoulders include planar surfaces substantially parallel to the plane of the cartridge receiving surface.

9. The cartridge follower of claim 1 wherein the cartridge follower is constructed from one or more materials selected from the group consisting of metals, plastics, rubbers, woods, graphite, polymethylmethacrylate, polytetrafluoroethylene ("PTFE"), composite materials, and combinations thereof.

10. A cartridge follower for a Kalashnikov type firearm bolt hold open magazine including:

a cartridge receiving surface including a planar surface portion and a raised surface portion operationally configured to intercept a Kalashnikov type firearm bolt; and side walls depending from the cartridge receiving surface, the side walls having inner surfaces defining a space there between and opposing first surfaces defining a first width of the cartridge receiving surface and at least opposing second surfaces defining a second width of the cartridge receiving surface wherein the second surface of one side wall depends from the planar surface portion and the second surface of the other side wall depends from the raised surface portion;

a back wall depending from the cartridge receiving surface and the raised surface portion, the back wall having an outer surface including a width defined by said first width and an inner surface including a width defined by the distance between the inner surfaces of the side walls;

wherein the opposing first surfaces include first front faces of the side walls and the opposing second surfaces include second front faces of the side walls; and wherein the cartridge receiving surface includes a ledge extending beyond the first and second front faces of the side walls.

11. The cartridge follower of claim 10 wherein the cartridge follower is constructed from plastic.

12. The cartridge follower of claim 11 wherein the raised surface portion is reinforced with one or more metals.

13. The cartridge follower of claim 11 further including an external member attached to the raised surface portion, the external member being operationally configured to receive impacts from firearm bolts during operation of a Kalashnikov type firearm.

14. The cartridge follower of claim 13 wherein the external member is constructed from steel.

* * * * *